United States Patent [19]

Miller

[11] Patent Number: 4,982,913

[45] Date of Patent: Jan. 8, 1991

[54] COURSE CORRECTION UNIT

[75] Inventor: Lee Miller, Bristol, England

[73] Assignee: British Aerospace Public Limited Company, London, England

[21] Appl. No.: 409,561

[22] Filed: Sep. 19, 1989

[30] Foreign Application Priority Data

Sep. 22, 1988 [GB] United Kingdom ..... 8822282

[51] Int. Cl.[5] ..... F42B 15/18

[52] U.S. Cl. ..... 244/3.22; 102/202; 102/381

[58] Field of Search ..... 244/3.22; 102/202, 381

[56] References Cited

U.S. PATENT DOCUMENTS

| | | | |
|---|---|---|---|
| 3,011,441 | 12/1961 | Gordon | 102/202 |
| 3,204,559 | 9/1965 | Matthew | 102/202 |
| 3,380,382 | 4/1968 | Jablansky | 102/381 |
| 4,384,694 | 5/1983 | Watanabe et al. | 244/3.22 |

*Primary Examiner*—Charles T. Jordan
*Assistant Examiner*—Rochelle Lieberman
*Attorney, Agent, or Firm*—Cushman, Darby & Cushman

[57] ABSTRACT

This invention relates to a course correction unit, specifically but not exclusively for use on a spin stabilized guided projectile which can produce high speed instantaneous course correction.

7 Claims, 1 Drawing Sheet

COURSE CORRECTION UNIT

This invention relates to a course correction unit, specifically but not exclusively for use on a spin stabilised guided projectile.

A spin stabilised projectile is generally launched along the line of sight towards a target. With the use of, for example, beam rider apparatus, the projectile can determine its position within a field of view and if necessary take action to correct its course so as to achieve impact with the target.

A problem exists with course correction for relatively small projectiles. In order to correct the course sufficient momentum must be created to cause the required deviation. This momentum may generally be produced by a mass flow rate of gas through an aperture or jet. The mass flow rate is directly proportional to the pressure of gas and the area of the aperture or jet. In a small projectile there is a limit on the amount by which the area of the aperture can be increased. Hence to increase mass flow rate, pressure must be increased. It is often very difficult to achieve and control the high pressure required and to achieve opening of the aperture at the instant when pressure is at the required level and the aperture is "pointing" in the required direction. It is also difficult to keep the aperture closed under the high pressures that may be generated.

One way in which course correction can be achieved is by firing bonker jets which are generally circumferentially spaced around the body of the projectile. There is a problem, however, with course correcting in this way, due to the fact that at high spin speeds the bonker jets may be jetting for up to say one complete revolution of projectile. This obviously will not achieve any course correction.

Accordingly, one object of the present invention is to provide a course corection unit which can generate a high thrust over a small degree of revolution.

According to one aspect of the present invention there is provided a course correction unit comprising:

a chamber to be filled with propellant in use;

a valve member of non-uniform cross-section; and, releasable securing means for holding said valve member closed, characterised in that said securing means is configured to release the valve memeber at a predetermined pressure.

Reference will now be made, by way of example, to the accompanying drawings, in which.

Figure 1:
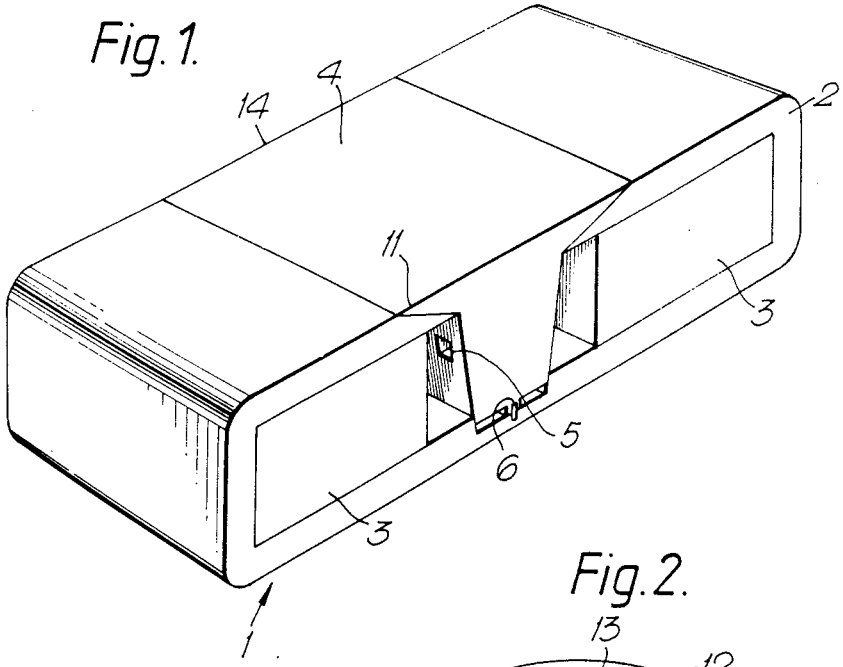
FIG. 1 is a diagram of one embodiment of a transient high thrust (THT) motor according to the present invention.

The THT motor shown generally at 1 comprises a case 2 which defines two propellant chambers 3 and a tapered valve 4. The valve 4 is solid, apart from several transverse passageways 5 which help equalise the pressure in two chambers 3, and is held in place by, for example, a shearing pin 6. The shearing pin 6 is designed to have a breaking point at a well defined pressure.

Figure 3:
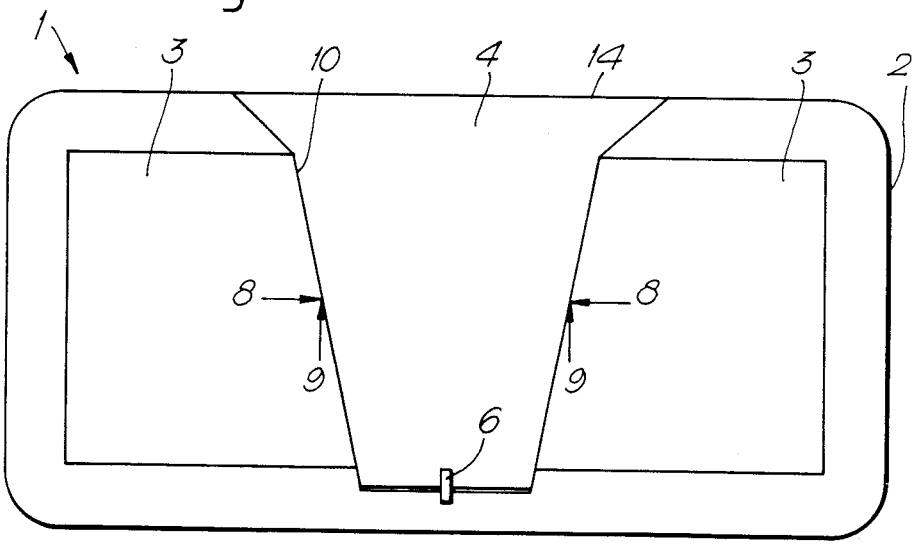
FIG. 3 is a cross-sectional view of the FIG. 1 motor.

In order for the motor 1 to work, the propellant within the propellant chamber 3 is ignited by any appropriate method. As the propellant burns within the chamber 3 the pressure within the chamber increases. The force exerted on the valve is shown in FIG. 3. Due to the fact that pressure acts normally to a surface, there is a large horizontal component 8 acting on the valve in each direction left to right and right to left from respective chambers and a smaller vertical component 9. The effect of the horizontal component is essentially cancelled out irrespective of pressure, but as the pressure increases the force generated by the vertical component increases. It is the vertical component which at a predetermined level causes shearing pin 6 to break by acting on the tapered edges 10 of the valve 4.

At this point the pressure in the chamber is quite considerable and the valve 4 is forced out, along with the gas that has built up as the propellant burned. The speed at which the valve is jettisoned can be increased by ensuring that the base of the tapered valve is flat. This allows the HP gas to exert a greater vertical force component. This causes a transient high thrust which is used to correct the course of the projectile.

It is envisaged that a number of the motors described above will be incorporated into a projectile with the outer surface 11 of the case and the tapered valve being flush with the projectile walls.

Alternatively, a circumferential unit (not shown) may be incorporated, the unit comprising a number of segments, into the projectile. Each segment being separate from the others and having their own valves.

Figure 2:
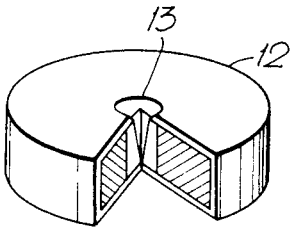
FIG. 2 is a diagram of a second embodiment of a similar THT motor.

A second embodiment as shown in FIG. 2, comprises a cylindrical chamber 12 and a nail-shaped valve 13. The valve 13 is held in position by, for example, a shear pin (not shown). The chamber is filled with propellant which when ignited generates a gas pressure. As the gas pressure increases the vertical component of the force generated by the pressure increases until the force is sufficient to break the shear pin. At this point both the shear pin and the gas produced as the propellant is burned will be ejected from the chamber, thereby producing the required course correction.

As with the first embodiment a number of the devices of FIG. 2 are placed circumferentially around the projectile, with the outer surface 14 being flush with the projectile walls.

In either embodiment, it is possible to replace the shearing pin with an alternative "weak link". For example, a thermal device may be used which breaks at a certain temperature, thereby releasing the valve. Another possibility is to use a pressure sensitive device which breaks at a predetermined pressure. Alternatively, a pin with a simple explosive device may be used, as long as the explosion is controlled and does not damage the chamber.

It will be appreciated that in order for the heat or pressure "weak links" to work, the link will have to be exposed to the gas produced as the propellant burns. This may be achieved by the addition of a gap between the case and the valve in the region of the shear pin.

It will also be appreciated that any shaped motor may be designed to fit in any available place, and that the device may be of any suitable size.

I claim:

1. A course correction unit comprising:

a chamber to be filled with propellant in use;

a valve member of non-uniform cross-section; and releasable securing means, comprising a frangible link, for holding said valve member closed, characterised in that said securing means is configured to release the valve member at a predetermined pressure.

2. A course correction unit according to claim 1, wherein said valve member is tapered.

3. A course correction unit according to claim 1, wherein said valve member has shoulders.

4. A course correction unit according to any one of the preceding claims, wherein said securing means releases owing to a shearing force acting on the tapered sides of the valve.

5. A course correction unit according to any one of claim 1, wherein said securing means releases at a predetermined temperature.

6. A course correction unit according to any one of claims 1 to 3, wherein said chamber comprises a pressure sensor which is operable to cause release of the securing means at a predetermined pressure.

7. A course correction unit according to any one of claims 1 to 3, wherein said securing means comprises an explosive device which is operable to cause release of the securing means.

* * * * *